US006041700A

United States Patent [19]

Sebastian et al.

[11] Patent Number: 6,041,700

[45] Date of Patent: Mar. 28, 2000

[54] INTAKE FOR BELT-TYPE PARTICLEBOARD PRESS

[75] Inventors: Lothar Sebastian, Bochum; Horst Weiss, Krefeld; Klaus Schürmann, Jüchen, all of Germany

[73] Assignee: G. Siempelkamp GmbH & Co., Krefeld, Germany

[21] Appl. No.: 09/252,350

[22] Filed: Feb. 18, 1999

[30] Foreign Application Priority Data

Feb. 18, 1998 [DE] Germany ..... 198 06 707

[51] Int. Cl.[7] ..... B30B 5/06; B30B 15/02; B27N 3/24

[52] U.S. Cl. ..... 100/152; 100/154; 92/118

[58] Field of Search ..... 100/151, 152, 100/154; 425/371, 149; 156/555, 583.3, 583.5; 92/118

[56] References Cited

U.S. PATENT DOCUMENTS

| | | | |
|---|---|---|---|
| 3,168,014 | 2/1965 | Aslan | 92/118 |
| 3,314,336 | 4/1967 | Jorgji | 92/118 |
| 4,647,417 | 3/1987 | Bottger et al. | 100/154 |
| 5,112,431 | 5/1992 | Gerhardt et al. | 100/154 |
| 5,454,304 | 10/1995 | Bielfeldt | 100/154 |

FOREIGN PATENT DOCUMENTS 195 18 879 12/1996 Germany .

*Primary Examiner*—Peter Vo
*Assistant Examiner*—Louis Huynh
*Attorney, Agent, or Firm*—Herbert Dubno; Andrew Wilford

[57] ABSTRACT

A press for pressing a mat into a thin panel has a press frame, upper and lower press plates on the frame, upper and lower press belts having confronting lower and upper stretches defining a press gap extending in a horizontal and longitudinal transport direction and respectively running below and above the upper and lower press plates, and upper and lower flexible intake plates juxtaposed respectively above and below upstream ends of the lower and upper stretches of the belts and defining therewith an intake mouth flaring upstream. An array of spaced fluid-powered actuators carried on the frame each have outer ends juxtaposed with one of the intake plates. Thermal insulation is provided between the actuator outer ends and the one intake plate to protect the actuators from the heat of the intake plates. Swivel joints, normally ball joints, are provided between the actuator outer ends and the one intake plate.

10 Claims, 3 Drawing Sheets

INTAKE FOR BELT-TYPE PARTICLEBOARD PRESS

FIELD OF THE INVENTION

The present invention relates to a belt-type continuous press. More particularly this invention concerns such a press used for making particleboard.

BACKGROUND OF THE INVENTION

In the manufacture of particleboard, which term is intended to cover chipboard and flakeboard, it is standard to compress a relatively thick mat by a factor of eight or more into a hard panel. The mat is soft and comprised of wood particles mixed with a phenolic or other binder. The finished workpiece is a hard board or panel with a pair of planar faces.

Such a panel is produced in a continuous press having a rigid press frame having vertically spaced upper and lower parts defining a press gap that can extend some 30 m. Upper and lower belts are spanned in the respective press parts between respective upstream and downstream rollers, at least one of which is driven to advance confronting upper and lower stretches of the lower and upper belts longitudinally through the press. Upper and lower press plates bear on the lower and upper surfaces of the upper and lower stretches of the lower and upper belts. Normally arrays of rollers run between each belt and the respective supporting plate to reduce friction.

The two belts typically are braced at an intake mouth of the gap against flexible intake members or plates. The mouth flares upstream. These intake members are typically braced against the press frame by hydraulic cylinders that are hooked to a common controller so that the shape of the intake mouth can be set centrally. Such systems are described in German patent documents 195 18 879 and in copending U.S. patent application Ser. Nos. 09/152,931 and 09/152,941.

In these arrangements, even when the actuators are secured at their ends by cardan joints, the intake plates and, hence, the belts passing over them, have perceptible bends at the actuators. These bends create points of excessive wear and subject the incoming mat to suddenly varying compression.

OBJECTS OF THE INVENTION

It is therefore an object of the present invention to provide an improved continuous belt-type mat press.

Another object is the provision of such an improved continuous belt-type mat press which overcomes the above-given disadvantages, that is which avoids the perceptible bends at the actuators in the intake plates.

SUMMARY OF THE INVENTION

A press for pressing a mat into a thin panel has according to the invention a press frame, upper and lower press plates on the frame, upper and lower press belts having confronting lower and upper stretches defining a press gap extending in a horizontal and longitudinal transport direction and respectively running below and above the upper and lower press plates, and upper and lower flexible intake plates juxtaposed respectively above and below upstream ends of the lower and upper stretches of the belts and defining therewith an intake mouth flaring upstream. An array of spaced fluid-powered actuators carried on the frame each have outer ends juxtaposed with one of the intake plates. Thermal insulation is provided between the actuator outer ends and the one intake plate to protect the actuators from the heat of the intake plates. Swivel joints, normally ball joints, are provided between the actuator outer ends and the one intake plate.

As a result the intake plates can bend in a uniform curve. The actuators will not be cause the curve to flex at each attachment location since the connection between the actuators and the one intake plate will be able to tip from side to side and front to back as necessary to produce the desired intake-mouth shape. As a result it is possible to produce workpieces with thicknesses as small as 3 mm without the risk of the mats tearing, even when the intake plates are substantially parallel. In addition the use of such swivel joints allow very flexible intake plates to be used that can be deformed to virtually any desired shape.

Each swivel joint comprises according to the invention a shell fixed on the one intake plate and having a part-spherical outer surface turned toward the respective actuator outer end and a concentric part-spherical inner surface turned away from the respective actuator outer end, a seat formed on the respective actuator outer end and complementarily engaging the shell outer surface, and a head fixed on the respective actuator outer end and having a surface riding on and complementary to the shell inner surface. The shells are each formed with a throughgoing hole and the head has a stem extending with lateral play through the hole and fixed to the respective actuator outer end.

The thermal insulation in accordance with the invention includes insulating rings engaged between the shell and the one intake plate. These insulating rings include upper and lower rings set into a rim of the shell. Retaining blocks clamp the rings and shell rim to the one intake plate. A pressure plate is provided between the insulating rings and the shell. The rim of the shell is steel and planar and sits directly on the pressure plate. In addition respective other insulating rings may surround the pressure plates and be engaged by the retaining blocks.

Furthermore according to the invention the actuators have inner ends juxtaposed with the frame. The press further has swivel joints between the actuator inner ends and the frame and each including a shell fixed on the frame and having a part-spherical outer surface turned toward the respective actuator inner end and a concentric part-spherical inner surface turned away from the respective actuator inner end, a seat formed on the respective actuator outer end and complementarily engaging the shell outer surface, and a head fixed on the respective actuator outer end and having a surface riding on and complementary to the shell inner surface. Respective crosspieces are provided above each of the actuators on the frame and respective tie screws extending vertically through the crosspieces have upper head ends bearing downwardly on the respective crosspiece and lower ends threaded into the respective shell.

Normally in accordance with the invention the one intake plate is the upper intake plate, although it is within the scopy of the invention for both intake plates to be provided with actuators according to the invention. In the system with the actuators above the upper plate the frame includes respective crosspieces above each of the actuators. Respective tie screws extending vertically through the crosspieces and have upper head ends bearing downwardly on the respective crosspieces and lower ends threaded into the respective actuator. If there are actuators for the lower press plate instead of or in addition to those of the upper plate, they are complementarily arranged.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
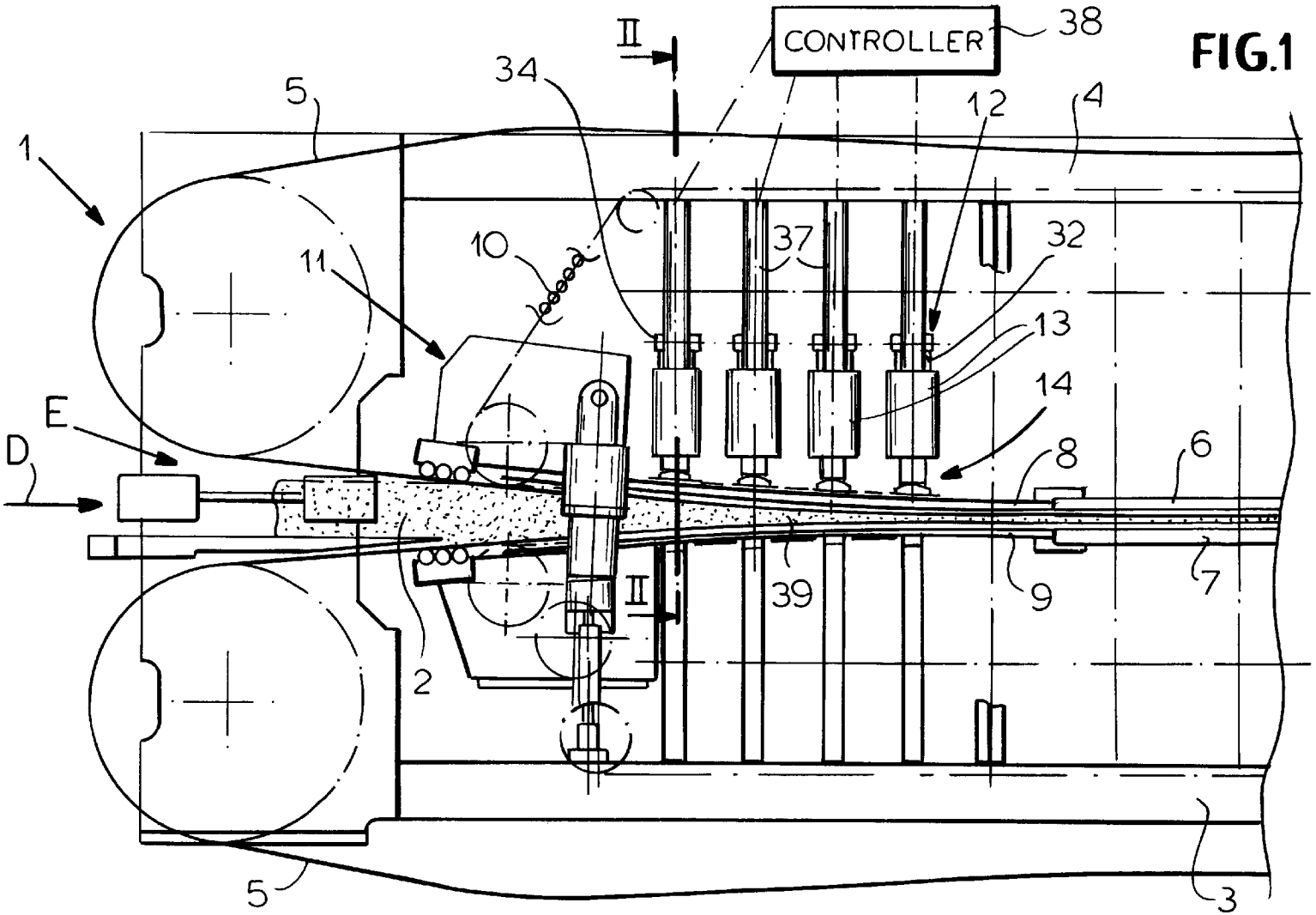
FIG. 1 is a partly diagrammatic side view illustrating a press according to the invention.
Figure 2:
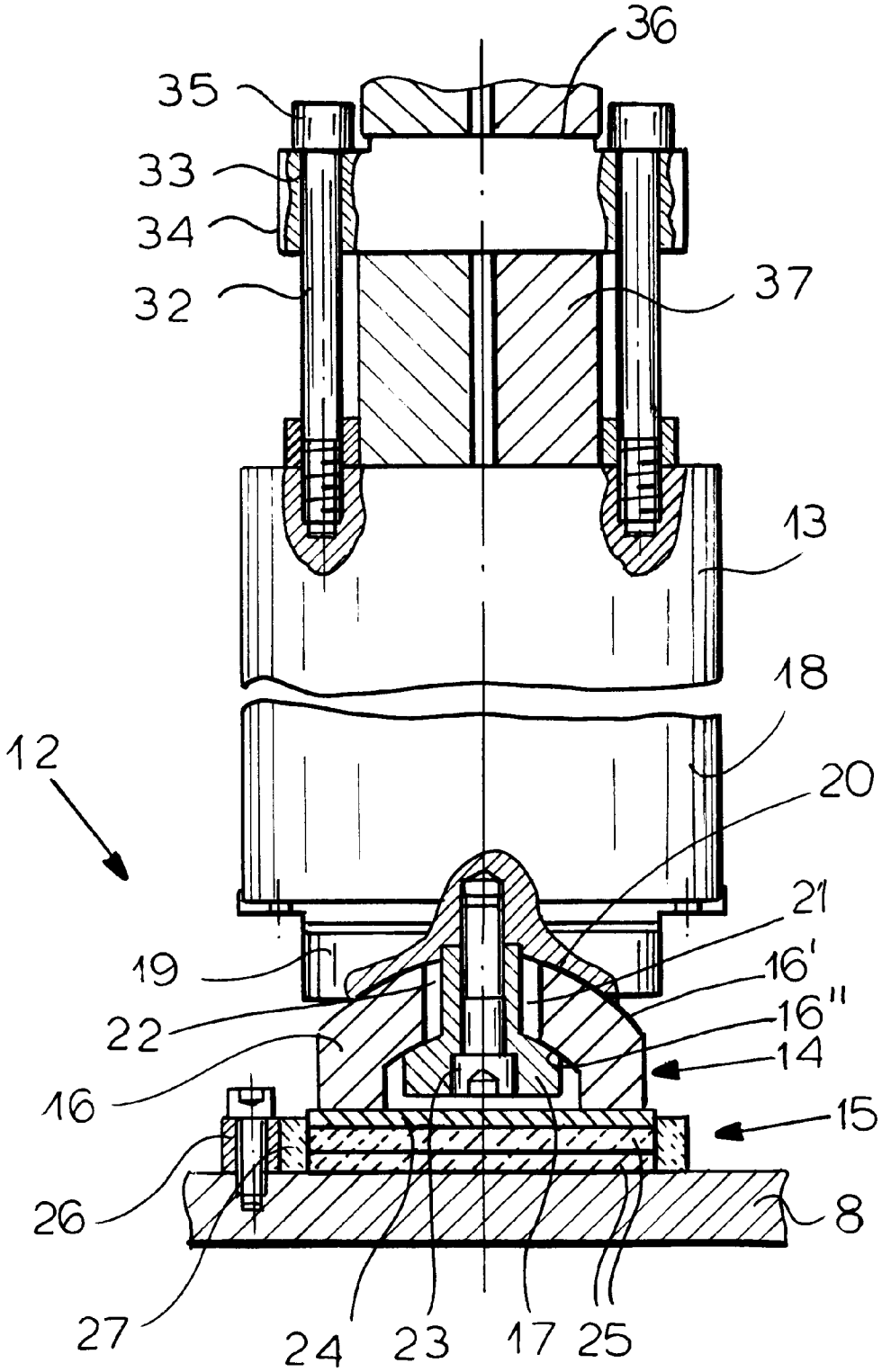
FIG. 2 is a section taken along line II—II of FIG. 1 showing a detail of the press.

As seen in FIGS. 1 and 2 a press 1 according to the invention serves to compress a thick mat 2 of particles and binder. It has a frame formed by a lower part 3 and an upper part 4. A pair of endless stainless-steel belts 5 have confronting lower and upper stretches riding over upper and lower heated press platen 6 and 7 and flexible upper and lower intake plates 8 and 9 to define a pressing gap 39 extending in a horizontal mat transport direction D and having an intake mouth E that opens upstream in the direction D and that is flared against this direction D. Respective arrays of rollers 10 ride between the belts 5 and the plates 6–9 to allow the belts 5 to move smoothly with little friction. The gap 39 is basically subdivided into an upstream portion at the mouth E where the mat 2 is compressed almost down to its finished size, and a downstream portion in which the mat 2 is held at this compressed size and heated to fix its binder. More particularly, the press gap 39 starts at the intake mouth E where in FIG. 1 it is relatively wide to accommodate the mat 2. A system 11 is provided for setting the width of the upstream end of the mouth E and another system 12 is provided for setting the shape of the belts 5 and plates 8 and 9 downstream along the intake mouth E.

According to the invention the system 12 is comprised of an array of heavy-duty double-acting hydraulic cylinders or actuators 13 operated by a common controller 38 and spaced apart in and transversely of the direction D, that is forming at least two rows extending in the direction D. Each such cylinder 13 has an upper end secured to a depending beam or bar 37 of the upper press part 4 and a lower end bearing via a ball-and-socket joint 14 and insulation 15 on the upper plate 8. of course it would also be possible to use pneumatic cylinders, the term "fluid" here intended to cover gas and liquid.

As better shown in FIG. 2 the joints 14 each comprise a downwardly concave cup-shaped shell 16 having a part-spherical upper surface 16' and a part-spherical lower surface 16" concentric therewith. The lower end of the actuator 13 is provided with a mounting plate 19 having a part-spherical seat 20 complementary to the part-spherical upper surface 16'. A head piece 17 has an upwardly directed part-spherical surface complementary to and engaging the surface 16" and a small-diameter stem 22 extending up through a large-diameter hole 21 in the shell 16. A screw 23 extending coaxially through the stem 22 secures the head piece 17 to the plate 19. The lower edge of the shell 16 bears via a pressure plate 24 and several insulating plates 25 on the plate 8. An insulating ring 27 surrounding the plates 24 and 25 is secured in place by a holding ring 26 which can be in several pieces. It is therefore possible for the plate 8 to rock from front to back and from side to side relative to the actuators 13 while these actuators 13 continue to exert the desired downward pressure on the plate 8.

The actuators 13 are each connected to the bar 37 by means of a crosspiece beam 34 that fits through a crosswise hole 36 in the bar and by long tie screws 32 having lower ends screwed into the upper side of the actuator 13. To this end the outer ends of the crosspiece 34 are formed with vertically throughgoing holes 33 and heads 35 bear on upper surfaces of the crosspieces 34. Thus each actuator 13 is rigidly locked to the cross beam 37, but the plate 8 can tip from side to side and front to back relative to its lower end without putting any significant lateral stress on the actuator 13.

Figure 3:
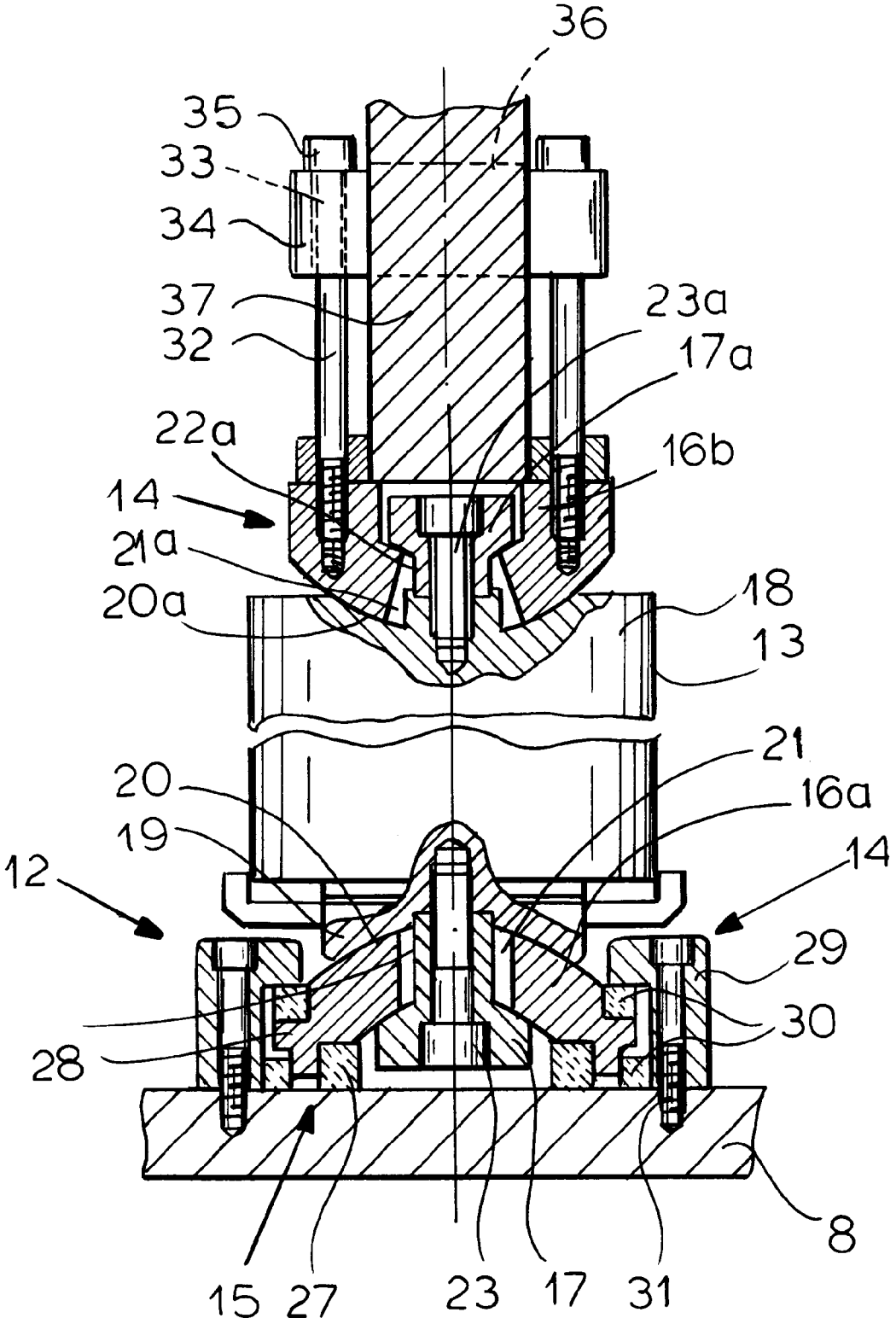
FIG. 3 is a view like FIG. 2 of an alternative press in accordance with the invention.

In the arrangement of FIG. 3 a shell 16*a* substantially identical to the shell 16 of FIGS. 1 and 2 has a rim 28 engaged between lower and upper insulating rings 27 and 30 and captured under L-shaped holddown blocks 29 secured in place by screws 31. In addition the upper end of the housing 18 of the actuator 13 is provided with another such headpiece 17*a* engaged in another upwardly concave shell 16*b* whose part-spherical lower face is slidable on a part-spherical seat 20*a* of the housing 18 and which is secured in place by the tie screws 32. A screw 17*a* extending through a stem 22*a* of the headpiece 17*a* secures it to the housing 18 so that the upper end of the actuator 13 can also swivel.

We claim:

1. A press for pressing a mat into a thin panel, the press comprising:

a press frame;

upper and lower press plates on the frame;

upper and lower press belts having confronting lower and upper stretches defining a press gap extending in a horizontal and longitudinal transport direction and respectively running below and above the upper and lower press plates;

upper and lower flexible intake plates juxtaposed respectively above and below upstream ends of the lower and upper stretches of the belts and defining therewith an intake mouth flaring upstream;

an array of spaced fluid-powered actuators carried on the frame and having outer ends juxtaposed with one of the intake plates;

thermal insulation between the actuator outer ends and the one intake plate; and ball joints between the actuator outer ends and the one intake plate each including a shell fixed on the one intake plate and having a part-spherical outer surface turned toward the respective actuator outer end and a concentric part-spherical inner surface turned away from the respective actuator outer end;

a seat formed on the respective actuator outer end and complementarily engaging the shell outer surface; and a head fixed on the respective actuator outer end and having a surface riding on and complementary to the shell inner surface.

2. The press defined in claim 1 wherein the actuators have inner ends juxtaposed with the frame, the press further comprising swivel joints between the actuator inner ends and the frame.

3. The press defined in claim 1 wherein each shell is formed with a throughgoing hole and the head has a stem extending with lateral play through the hole and fixed to the respective actuator outer end.

4. The press defined in claim 3 wherein the thermal insulation includes insulating rings engaged between the shell and the one intake plate.

5. The press defined in claim 4 wherein the rings include upper and lower rings set into a rim of the shell, the press further comprising retaining blocks clamping the rings and shell rim to the one intake plate.

6. The press defined in claim 5, further comprising a pressure plate between the insulating rings and the shell.

7. The press defined in claim 6 wherein the rim is steel and planar and sits directly on the pressure plate.

8. The press defined in claim 6, further comprising respective other insulating rings surrounding the pressure plates and engaged by the retaining blocks.

9. A press for pressing a mat into a thin panel, the press comprising:

a press frame;

upper and lower press plates on the frame;

upper and lower press belts having confronting lower and upper stretches defining a press gap extending in a horizontal and longitudinal transport direction and respectively running below and above the upper and lower press plates;

upper and lower flexible intake plates juxtaposed respectively above and below upstream ends of the lower and upper stretches of the belts and defining therewith an intake mouth flaring upstream;

an array of spaced fluid-powered actuators carried on the frame and having outer ends Juxtaposed with one of the intake plates and inner ends Juxtaposed with the frame;

thermal insulation between the actuator outer ends and the one intake plate;

swivel joints between the actuator outer ends and the one intake plate;

swivel joints between the actuator inner ends and the frame and each including a shell fixed on the frame and having a part-spherical outer surface turned toward the respective actuator inner end and a concentric part-spherical inner surface turned away from the respective actuator inner end;

a seat formed on the respective actuator outer end and complementarily engaging the shell outer surface; and a head fixed on the respective actuator outer end and having a surface riding on and complementary to the shell inner surface;

respective crosspieces above each of the actuators on the frame; and respective tie screws extending vertically through the crosspieces and having upper head ends bearing downwardly on the respective crosspiece and lower ends threaded into the respective shell.

10. A press for pressing a mat into a thin panel, the press comprising:

a press frame;

upper and lower press plates on the frame;

upper and lower press belts having confronting lower and upper stretches defining a press gap extending in a horizontal and longitudinal transport direction and respectively running below and above the upper and lower press plates;

upper and lower flexible intake plates juxtaposed respectively above and below upstream ends of the lower and upper stretches of the belts and defining therewith an intake mouth flaring upstream;

an array of spaced fluid-powered actuators carried on the frame and having outer ends Juxtaposed with one of the intake plates;

thermal insulation between the actuator outer ends and the one intake plate;

swivel joints between the actuator outer ends and the upper intake plate;

respective crosspieces above each of the actuators; and respective tie screws extending vertically through the crosspieces and having upper head ends bearing downwardly on the respective crosspieces and lower ends threaded into the respective actuator.

* * * * *